US006146283A

United States Patent [19]

Ferguson, III

[11] Patent Number: 6,146,283

[45] Date of Patent: Nov. 14, 2000

[54] GOLF PUTTING TRAINING DEVICE

[76] Inventor: Joseph M. Ferguson, III, 4515 Crestwicke Point, Atlanta, Ga. 30319

[21] Appl. No.: 09/134,209

[22] Filed: Aug. 14, 1998

[51] Int. Cl.[7] ..... A63B 57/00

[52] U.S. Cl. ..... 473/145; 473/151; 473/140

[58] Field of Search ..... 473/145, 146, 473/140, 131, 151, 154, 173, 174, 186, 188, 189, 190, 192, 198, 199, 404

[56] References Cited

U.S. PATENT DOCUMENTS

| | | | |
|---|---|---|---|
| 1,940,970 | 12/1933 | Schollmeyer | 473/145 |
| 3,301,561 | 1/1967 | Kaiser | 273/186 |
| 3,421,376 | 1/1969 | Lindahl | 73/379 |
| 3,472,075 | 10/1969 | Oppenheimer | 73/379 |
| 3,479,878 | 11/1969 | Loeffler | 473/145 |
| 3,601,408 | 8/1971 | Wright | 273/186 R |
| 3,647,219 | 3/1972 | Ravatt | 473/145 |
| 4,306,722 | 12/1981 | Rusnak | 273/186 R |
| 4,327,918 | 5/1982 | Foster | 273/186 R |
| 4,848,769 | 7/1989 | Bell et al. | 473/145 |
| 4,872,687 | 10/1989 | Dooley | 473/145 |
| 5,121,923 | 6/1992 | D'Allura | 473/145 |
| 5,181,721 | 1/1993 | Halliburton | 473/145 |
| 5,423,538 | 6/1995 | Stewart | 273/183.1 |
| 5,435,547 | 7/1995 | Lee | 273/186.1 |
| 5,527,041 | 6/1996 | Terry, III et al. | 473/150 |
| 5,586,940 | 12/1996 | Dosch et al. | 473/140 |
| 5,692,966 | 12/1997 | Wash | 473/221 |

OTHER PUBLICATIONS

Delta Airlines SkyMall Catalog, summer 1998, p. 36.

*Primary Examiner*—Jessica J. Harrison

*Attorney, Agent, or Firm*—Troutman Sanders LLP; Gerald R. Boss, Esq.

[57] ABSTRACT

A golf training device is provided to assist a golfer in practicing their respective putting stroke by accurately indicating the distance a practice putt would have traveled upon a simulated green having a selected stimp value. The golf training device includes a putting target, a sensor for measuring the putting force applied to the putting target, a variable stimp selector enabling the golfer to select a specific stimp value representative of a putting green having the correlating stimp value, a microprocessor which calculates an respective putting distance based on the putting force and selected stimp value; and a display for displaying the respective putting distance to the golfer.

20 Claims, 1 Drawing Sheet

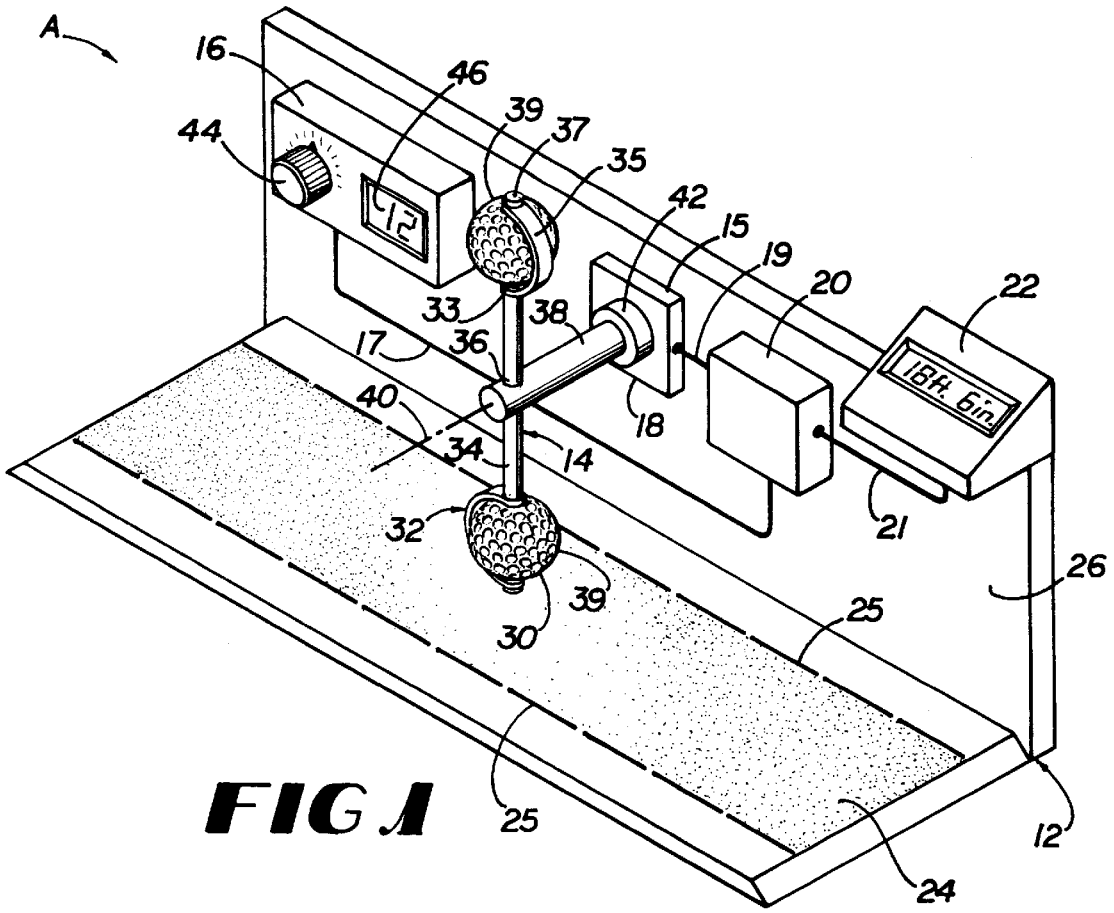
FIG 1
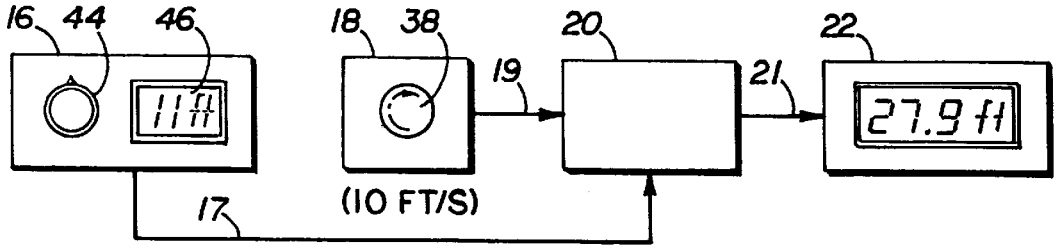
FIG 2
STIMP NUMBER (f)
| $V_d$ (f/s) | 7 | 8 | 9 | 10 | 11 | 12 |
|---|---|---|---|---|---|---|
| 1 | 0.18 | 0.20 | 0.23 | 0.25 | 0.28 | 0.30 |
| 2 | 0.71 | 0.81 | 0.91 | 1.02 | 1.12 | 1.21 |
| 4 | 2.85 | 3.25 | 3.66 | 4.06 | 4.47 | 4.88 |
| 8 | 11.38 | 13.00 | 14.63 | 16.26 | 17.88 | 19.51 |
FIG 3

GOLF PUTTING TRAINING DEVICE

BACKGROUND OF THE INVENTION

1. Technical Field

This invention relates generally to a golf putting training device and in particular to a golf putting training device which provides an indication as to how far a golf ball would actually travel on a putting surface having a particular stimp value in response to the force of a golfer's putting stroke.

2. Description of the Prior Art

A large percentage of the golf strokes in a typical round are directed towards putting the ball into the cup after it has been successfully driven to the green. Accordingly, almost all serious golfers are constantly working to improve their putting skills. Successful putting depends in large part upon the golfer's proper consideration of the frictional resistance of the green surface and the contour and terrain of the green surface.

The frictional resistance of a green surface is commonly expressed in terms of a stimp number. The stimp number is a measure of the distance which a ball will travel on a level green when released from a stimp meter. A stimp meter is a simple device consisting of an aluminum trough with a length of 30 inches inclined at a 20 degree angle from the horizontal green surface. A ball released from a stimp meter will always have the same initial velocity when it comes into contact with the green surface and will travel a certain distance on a horizontal green depending upon the friction imparted to the ball by the putting green. The distance which the ball travels is that particular green's stimp number. Stimp numbers typically range from about 7 feet for very slow greens to about 12 feet for very fast greens.

A variety of golf training devices have been developed to aid a golfer in practicing their putting stroke. For example, U.S. Pat. No. 5,692,966 discloses a golf putting trainer which aids a golfer in perfecting the alignment of their putting stroke by utilizing reflected light to determine the angle of the putter head. Similarly, U.S. Pat. No. 5,527,041 discloses a golf putting trainer which assists a golfer in training both the alignment of their putting stroke swing and the angle of the putter head by utilizing a pair of guide rails and a visible light beam along which the golfer may strike the ball. While each of these training devices effectively aids the golfer in perfecting their putter head alignment and stroke path, none of these devices are useful for training the force with which the golfer must strike the ball to obtain a putt of a desired distance on a particular green surface.

U.S. Pat. No. 3,472,075 discloses a golf simulation game which includes both a driving simulation device and a device for simulating putts on a variety of green surfaces. The driving simulation device utilizes counterbalanced balls mounted on either end of a spinning rod which a golfer may strike to simulate driving a golf ball. A mechanical counter coupled to the spinning of the rod provides an rough estimate of the distance a driven golf ball would have traveled in response to the golfer's swing. The driving simulator also includes a knob to vary the resistance of the spinning rod to roughly account for the different club choices or whether for simulation purposes the ball is being hit from a fairway, rough or sand trap. While this mechanism is adequate, in the context of a simulation game, for providing a rough estimate of the distance a golf ball would travel in response to the force of a golfer's swing, it provides neither the means nor the level of accuracy necessary to assist a golfer in perfecting their putting distance.

A putting simulation device is also disclosed, as a part of the game. The putting simulation device utilize hanging curtain-like obstacles to dissipate a portion of the kinetic energy of a golf ball to effect a crude simulation of differing surfaces based on the characteristics and number of the obstacles. Again, while adequate for providing a rough estimate of a putting distance in a simulation game setting, this method clearly does not provide the golfer with an accurate correlation between the force of a putting stroke and the distance which the ball would actually travel on a green surface with given characteristics.

Therefore, it is an object of the present invention to provide a golf putting training device which allows a golfer to practice putting a golf ball a specific distance on a variety of surfaces.

It is a further object of the present invention to provide a golf putting training device which will accurately inform a golfer the distance a putt of a given force would travel on a green surface having a particular stimp value.

It is yet another object of the present invention to provide golf training device which will allow a golfer to practice lengthy putts in a small area.

SUMMARY OF THE INVENTION

The above objectives are accomplished according to the present invention by providing a golf training device to assist a golfer in practicing their respective putting stroke. The golf training device includes a putting target for receiving a putting stroke of a golfer having a certain force. A sensor is provided for measuring a parameter correlated to the putting force applied to the putting target and for producing a putting force signal. A variable stimp selector enables the golfer to select a specific stimp value representative of a putting green having the correlating stimp value. The variable stimp selector generates a stimp value signal indicative of the selected stimp value. A microprocessor receives the putting force signal and the stimp signal and uses them to calculate an effective putting distance. The microprocessor outputs a putting distance signal to a display which displays the respective putting distance to the golfer, providing the golfer with an accurate indication of the distance a practice putt would have traveled upon a simulated green having the selected stimp value.

The aforementioned and other aspects, objects and advantages of the present invention are described in the detailed description and attached illustrations which follow.

BRIEF DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown, and wherein:

FIG. 1 is a perspective view of a golf putting training device in accordance with the present invention.

FIG. 2 is a schematic diagram illustrating a putting force sensor system of a golf putting training device in accordance with the present invention.

FIG. 3. is a diagram illustrating a sample table of values of a golf putting training device in accordance with an embodiment the present invention

DETAILED DESCRIPTION OF THE INVENTION

As shown in FIG. 1, the golf putting training device A includes a putting target assembly 14 for receiving the putting stroke of a golfer and a putting force sensor system 15 for sensing the force of the golfer's putting stroke and displaying the distance that a respective putt of that force would propel a golf ball across a green surface having a particular stimp value. Golf putting training device A also includes frame 12 for supporting the putting target assembly 14 and the putting force sensor system 15.

As shown in FIG. 1, frame 12 includes horizontal putting guide 24 which is disposed in the path covered by the golfer's putting swing to simulate a green surface. Optionally, putting guide 24 may include guide markings 25 to assist the golfer in developing the alignment of their putting stroke. Frame 12 also includes side panel 26 which is disposed adjacent to horizontal putting guide 24 and carries putting target assembly 14, and putting force sensor system 15.

Also as shown in FIG. 1, putting target assembly 14 includes a rotatable central shaft 38 extending from side panel 26 and a plurality of putting target support rods 34 for supporting putting targets 30 for receiving the putting stroke of a golfer. Central shaft 38 is rotatably supported by sleeve 42 and defines an axis of rotation 40 about which the putting target assembly 14 may rotate in response to the force of a golfer's putting stroke.

As shown in FIG. 1, each putting target support rod 34 extends radially from central shaft 38 and includes an inner end 36 which is carried by central shaft 38 and an outer end 33 disposed away from central shaft 38. A putting target clip 32 is disposed at the outer end 33 of each putting target support rod 34 for securely holding a putting target 30 for receiving the putting stroke of a golfer. Each putting target clip 32 includes a C-shaped clamping member 35 for receiving a putting target 30 and a mounting screw 37 which may be tightened to secure a putting target 30 tightly in place. Preferably, a plurality of putting targets 30 are positioned upon a plurality of putting target support rods 34 positioned around shaft 38 to counterbalance one another.

Each putting target 30 has a size and shape generally equivalent to that of a standard golf ball, which generally range from about 1.68 inches to 1.8 inches in diameter. Preferably, the mass of each putting target 30 is proportionately less, based on the number of putting targets utilized, than that of a typical golf ball such that the overall inertial resistance provided by the putting target assembly 14 to the golfer's putting stroke is equivalent to that which would result when the golfer strikes a standard golf ball. This arrangement results in a putting feel similar to that which would the golfer would experience when striking an actual golf ball during a round of golf.

Optionally, actual golf balls 39 supplied by the golfer may be mounted in putting target clips 32 and used in place of the putting targets 30. However, if multiple golf balls 39 are used, then the resulting feel of the putting apparatus will be proportionately heavier than that which would the golfer would experience when striking an actual golf ball during a round of golf.

As shown in FIG. 1 and FIG. 2, putting force sensor system 15 includes a putting force sensor 18 for sensing the force of a golfer's putt, a stimp selector 16 for selecting a desired stimp value, and a microprocessor 20 for calculating an effective putt distance.

Sensor 18 is coupled to central shaft 38 and carried by side panel 26 for measuring a parameter related to the magnitude of the force of a golfer's putting stroke applied to a putting target 30. As shown in FIG. 2, sensor 18 generates an output signal indicative of the measured parameter via putting force signal line 19. However, a variety of other sensors types could be also be used to measure other parameters correlated to the force applied to the putting target 30. Alternate types of sensors, for example and not limitation, might include an odometer to measure the number of revolutions a given stroke causes the putting target assembly 14 to rotate before coming to rest or a force transducer which directly measures the force applied to putting target 30.

As shown in FIG. 1, stimp selector 16 is carried by side panel 26 and allows the golfer to select a desired stimp value to which the force of their putting stroke should be correlated. Stimp selector 16 may include a selector knob 44 with a plurality of settings corresponding to a plurality of stimp values representative of the stimp values of a variety of green surfaces. Stimp selector 16 may also include a selected stimp value display 46 for displaying the currently selected stimp value. Preferably, selected stimp value display 46 includes a digital LCD display mounted to side panel 26 at an angle easily viewable by a golfer. As shown in FIG. 2, stimp selector 16 also outputs a stimp value signal indicative of the selected stimp value via stimp value signal line 17.

One skilled in the art will readily recognize that a variety of other parameters related to a particular green surface than the stimp value might be similarly varied to aid a golfer in training his putting stroke. For example, a parameter such as the effective coefficient of friction of a green or the height of the grass surface of the green might be varied instead of a using a simple stimp number. Additionally, the slope of the simulated green surface might also be taken into account, allowing a golfer to practice putting at different angles.

As shown in FIG. 1, microprocessor 20 is carried within side panel 26 for calculating an effective putting distance and generating a signal indicative of the effective putting distance. Also as shown in FIG. 2, microprocessor 20 receives a putting force signal from sensor 18 via putting force signal line 19 and a stimp value signal from stimp selector 16 via stimp value signal line 17. Microprocessor 20 uses these signals to accurately calculate an effective putt distance indicative of the distance a putt of the measured force would propel a ball on a green surface having the selected stimp value. Microprocessor 20 generates an effective putt distance signal and outputs it via effective putt distance signal line 21. Display 22 is carried by side panel 26 for receiving the respective putt distance signal via effective putt distance signal line 21 and displaying the respective putt distance to the golfer. Preferably, display 22 includes a digital LCD display mounted to side panel 26 at an angle easily viewable by a golfer.

In a preferred embodiment, included for example and not limitation, microprocessor 20 accurately calculates the distance traveled by a ball in response to a putting stroke of a given strength based upon several assumptions. Firstly, the decelerative force encountered to a ball rolling across a green is assumed to be uniform along the path of the ball and independent of the speed of the ball. Secondly, the frictional and elastic and inelastic surface effects experienced by a rolling golf ball have been assumed to correlate to an effective coefficient of friction which may be related to the decelerative force.

Before calculating the distance which would be traveled by a ball rolling under the above specified conditions on a horizontal surface, it is first necessary to calculate the effective coefficient of friction for the surface. An effective coefficient of friction can be determined from the stimp number based on the following equations.

The distance traveled by an object before coming to rest under the influence of a constant decelerative force can be derived from the equation $x=\frac{1}{2}at^2$ where x is the distance traveled before the object comes to rest, a is the acceleration experienced as a result of the decelerative force and t is the time required for the object to come to rest. The time required for the object to come to rest may also be expressed by the relationship $t=v_o/a$ where $v_o$ is the initial velocity of the object. Applying this expression to the original equation $x=\frac{1}{2}at^2$ yields the relationship $x=v_o^2/2a$.

A golf ball released from a stimp meter will always have a the same velocity when it reaches the surface of a golf green, therefore $v_o$ will be a constant. This velocity can be calculated by applying the equation $v_o^2=1.4285\ g\ (x \sin\theta)$ which applies to any uniform spherical object rolling down an inclined plane of length x, where $v_o$ represents the final velocity of the sphere at the base of the incline, g is the gravitational constant (32.2 $ft/s^2$), and θ is the angle which the plane is inclined to the horizontal plane. For a stimp meter the length of the inclined plane is a constant 30 inches and the angle of inclination θ is a constant 20°. Therefore, for a stimp meter the above equation can be reduced to $v_o^2=1.4285(32.2\ ft/s^2)(2.5\ ft)\ \sin(20°)$ which equates to 39.33 $ft^2/s^2$. Solving for $v_o$ yields a constant value of 6.27 ft/sec which is the initial velocity of a ball released from a stimp meter onto any green.

The effective coefficient of friction $\mu_{eff}$ is related to the acceleration due to the decelerative force by the equation $a=g\mu_{eff}$. Substituting this expression into the equation $x=v_o^2/2a$ yields the relationship $x=v_o^2/2\mu_{eff}$. This equation can then be solved for $\mu_{eff}$ yielding the relationship $\mu_{eff}=v_o^2/2gx$. Since, in the case of a ball released from a stimp meter, the distance x is by definition equal to the stimp number, the effective coefficient of friction of a green surface having a particular stimp value x equals $(6.27\ ft/s)^2/2(x)(32.2\ ft/s^2)$. This simplifies to the relationship $\mu_{eff}=0.611/x$ Once calculated, the effective coefficient of friction may then be applied back into the same general equation $\mu_{eff}=v_d^2/2gd$ to relate the linear velocity $v_d$ to the distance d that a golf ball with that initial velocity would travel on a simulated surface having a stimp value of x. The resulting relationship is $d=v_d^2/2g\mu_{eff.}=v_d^2/2(32.2\ ft/s^2)(0.611/x)=0.0254\ v_d^2x$ where d and x are both expressed in ft. and $v_d$ is expressed in ft/s.

The initial velocity $v_d$ utilized in the above equations is a linear velocity representative of the actual velocity that the force of the golfer's swing would impart to a standard golf ball. It is therefore necessary to perform calculations or apply a conversion factor to account for the conversion of the parameter measured by sensor 18 to an equivalent linear velocity. Where sensor 18 is a tachometer, this conversion factor is simply 2πr where r is the radius of the putting target assembly 14. Furthermore, if the inertial mass of the putting target assembly 14 differs significantly from that of a single golf ball, as when two counterbalance golf balls are used, it is necessary to correct for the mass difference. The mass correction factor is approximately $m_{gb}/m_{pt}$, where $m_{gb}$ is the mass of a standard golf ball and $m_{pt}$ is the mass of the putting targets 30.

One skilled in the art will readily recognize that there are many other methods whereby a microprocessor might be used to accurately calculate the distance a putt of a given force would travel on a horizontal green surface with a given stimp number. For example, the above equations could be more accurately applied if actual frictional and elastic and inelastic surface effects were taken into account. In another alternate method, the distance traveled could be determined by simply comparing the selected stimp value and measured parameter related to putting force to a table of values maintained in a memory storage device included within microprocessor 20 and iterating between the values to obtain an estimation of the distance traveled. For example, using the sample table shown in FIG. 3, a golf ball can be found to travel 3.66 ft in response to a putting stroke producing a measured initial velocity of 8 ft/sec with a stimp value of 10 ft.

Thus, in operation a golfer may utilize a golf putting training device, as disclosed herein, to assist in perfecting their control of putting distance on a variety of putting green surfaces having varying stimp values. The golfer may first select a desired stimp value to correspond to the stimp value of a particular putting green surface. The golfer then strikes a putting target with a consistently practiced stroke, whereupon the distance an actual ball would travel upon a putting green surface having the selected stimp value is displayed. Alternately, the golfer might first choose a desired putting distance and then strike the putting target with a force the consider appropriate to propel a ball the desired distance on a green surface having the selected stimp value, thereby causing the golf putting training device to display an estimate of the distance an actual ball would have traveled on a green surface having the selected stimp value. The golfer may then repeatedly strike the putting target, correcting their putting force in accordance with the displayed distance in order to aid in the perfection of their putting skill.

Thus, it can be seen that an advantageous method may be had for training a golfers putting swing, according to the present invention, wherein the force of a golfer's putt may be measured and used to accurately calculate the distance which the putt would have actually traveled upon a green surface having a particular stimp value.

What have been described above are preferred embodiments of the present invention. It is, of course, not possible to describe every conceivable combination of methodologies for purposes of describing the present invention. However, one of ordinary skill in the art will recognize that many further combinations, permutations and modifications of the present invention are possible. Therefore, all such possible combinations, permutations and modifications are to be included within the scope of the claimed invention, as defined by the claims below.

What is claimed is:

1. A golf training device to assist a golfer in practicing their respective putting stroke, said training device comprising:

a putting target adapted to directly receive a putting stroke of a golfer having a certain putting force, wherein said putting target is rotatable about an axis at a predetermined distance from said axis, and wherein said putting target has a size and effective inertial resistance generally approximating the size and inertial resistance of a golf ball;

a putting force sensor adapted to produce a putting force signal related to the magnitude of said putting force which corresponds to a predetermined parameter of the rotation of said putting target about said axis;

a variable stimp selector adapted to generate a stimp value signal related to a selected stimp value;

a microprocessor responsive to said putting force signal and said stimp value signal for producing a putting distance signal; and a display responsive to said putting distance signal for producing a display illustrative of the distance traveled by a golf ball in response to said stroke.

2. The golf training device of claim 1, wherein said putting target includes a golf ball carried by a golf ball mounting mechanism.

3. The golf training device of claim 2, wherein said golf ball mounting mechanism includes a C-clamp and a set screw for securely holding said golf ball in place.

4. The golf training device of claim 1 further including a selected stimp value display responsive to said stimp value signal for producing a display of a selected stimp value.

5. The golf training device of claim 1, further including guide markings to aid the golfer in practicing the alignment of their respective putting stroke.

6. A golf training device to assist a golfer in practicing their respective putting stroke, said training device comprising:

a putting target for directly receiving a putting stroke of a golfer having a certain putting force, wherein said putting target is rotatable about an axis at a predetermined distance from said axis, and wherein said putting target has a size and effective inertial resistance generally approximating the size and inertial resistance of a golf ball;

a sensor for measuring a rotational parameter correlated to said putting force applied to said putting target and for producing a putting force signal;

a variable stimp selector enabling the golfer to select a specific stimp value representative of a putting green having the correlating stimp value, said variable stimp selector having a plurality of possible stimp settings for simulating a variety of putting green surfaces having various stimp values, said variable stimp selector also having a signal generator for producing a stimp signal indicative of the selected value;

a microprocessor for receiving said putting force signal and said stimp signal, said microprocessor calculating an effective putting distance utilizing said putting force signal and said stimp signal, said microprocessor also outputting a putting distance signal; and a display for receiving said putting distance signal and displaying a respective putting distance to the golfer;

whereby the golfer is provided with an accurate indication of the distance a practice putt would have traveled upon a simulated green having the selected stimp value.

7. The golf training device of claim 6, wherein said putting target includes a golf ball carried by a golf ball mounting mechanism.

8. The golf training device of claim 7, wherein said golf ball mounting mechanism includes a C-clamp and a set screw for securely holding said golf ball in place.

9. The golf training device of claim 6, further including a selected stimp value display for displaying the selected stimp value to the user.

10. The golf training device of claim 6, wherein said parameter correlated to a putting force measured by said sensor is the maximum rotational velocity of said putting target about said axis.

11. The golf training device of claim 6, wherein said parameter correlated to a putting force measured by said sensor is the number of rotations said putting target travels about said axis in response to said putting stroke.

12. The golf training device of claim 6, wherein said parameter correlated to a putting force measured by said sensor is the actual force applied to said putting target.

13. The golf training device of claim 6, wherein said microprocessor calculates said respective putting distance by using an effective coefficient of friction to determine a constant decelerating force which would be applied to a ball on a green surface with said selected stimp value.

14. The golf training device of claim 6, wherein said microprocessor calculates said respective putting distance by matching said putting force signal and said stimp signal to values obtained from a table maintained in a memory storage device.

15. The golf training device of claim 14, wherein said microprocessor iterates between the values obtained from said table to more accurately estimate said respective putting distance.

16. The golf training device of claim 6, further including guide markings to aid the golfer in practicing the alignment of their respective putting stroke.

17. A golf training device to assist a golfer in practicing their respective putting stroke, said training device comprising:

a putting target for directly receiving a putting stroke of a golfer having a certain putting force, wherein said putting target is rotatable about an axis at a predetermined distance from said axis, and wherein said putting target has a size and effective inertial resistance generally approximating the size and inertial resistance of a golf ball;

a sensor for measuring a rotational parameter correlated to a putting force applied to said putting target and for producing a putting force signal;

a variable selector enabling the golfer to select a parameter representative of a putting green having the correlating surface parameter, said variable selector also having a signal generator for producing a parameter signal indicative of the selected surface parameter;

a microprocessor for receiving said putting force signal and said parameter signal, said microprocessor calculating an effective putting distance utilizing said putting force signal and said parameter signal, said microprocessor also including a means for outputting a putting distance signal; and a display for receiving said putting distance signal and displaying a respective putting distance to the golfer;

whereby the golfer is provided with an accurate indication of the distance a practice putt would have traveled upon a simulated green having the selected surface parameter.

18. The golf training device of claim 17, wherein said parameter representative of a putting green is an effective coefficient of friction of the surface of said putting green.

19. The golf training device of claim 17, wherein said parameter representative of a putting green is the slope of a portion of the surface of said putting green.

20. The golf training device of claim 17, wherein said parameter representative of a putting green is the height of the grass comprising the surface of said putting green.

* * * * *